US008215758B2

(12) United States Patent
Takata

(10) Patent No.: US 8,215,758 B2
(45) Date of Patent: Jul. 10, 2012

(54) DAMPER DEVICE, DAMPER UNIT, LIQUID JETTING APPARATUS, AND METHOD OF MANUFACTURING DAMPER DEVICE

(75) Inventor: Masayuki Takata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 420 days.

(21) Appl. No.: 12/622,311

(22) Filed: Nov. 19, 2009

(65) Prior Publication Data

US 2010/0123767 A1 May 20, 2010

(30) Foreign Application Priority Data

Nov. 19, 2008 (JP) ..... 2008-296007
Nov. 19, 2008 (JP) ..... 2008-296010

(51) Int. Cl.
*B41J 2/17* (2006.01)

(52) U.S. Cl. ..... 347/94; 29/890.1

(58) Field of Classification Search ..... 347/94; 29/890.1
See application file for complete search history.

(56) References Cited

U.S. PATENT DOCUMENTS

| | | | | |
|---|---|---|---|---|
| 6,733,117 | B2 * | 5/2004 | Tajima et al. | 347/87 |
| 7,303,271 | B2 * | 12/2007 | Shimizu et al. | 347/94 |
| 2006/0176345 | A1 | 8/2006 | Koizumi | |
| 2006/0181583 | A1 * | 8/2006 | Usuda | 347/85 |

FOREIGN PATENT DOCUMENTS

| | | | |
|---|---|---|---|
| JP | 2006-163733 | A | 6/2006 |
| JP | 2006-231524 | A | 9/2006 |
| JP | 2007-223328 | A | 9/2007 |
| JP | 2007-245484 | A | 9/2007 |

* cited by examiner

*Primary Examiner* — Ellen Kim
(74) *Attorney, Agent, or Firm* — Baker Botts L.L.P.

(57) ABSTRACT

A damper device includes a storage chamber storing a liquid, and formed: of a substrate; a pair of supporting portions which are arranged to face each other in a predetermined facing direction, which project from the substrate, and peripheral portions of which have shapes substantially same with each other; and a film which is flexible and which has a sheet shape. The film is connected to the peripheral portions of the pair of supporting portions, and the storage chamber is formed as a space having a curved surface defined by the film. Accordingly, there is provided a damper device which is capable of stably exhibiting high damper performance, and in which the layout of channels which are connected to the damper device is simple.

30 Claims, 13 Drawing Sheets

DAMPER DEVICE, DAMPER UNIT, LIQUID JETTING APPARATUS, AND METHOD OF MANUFACTURING DAMPER DEVICE

CROSS REFERENCE TO RELATED APPLICATION

The present application claims priority from Japanese Patent Application No. 2008-296007 filed on Nov. 19, 2008 and Japanese Patent Application No. 2008-296010 filed on Nov. 19, 2008, the disclosures of which are incorporated herein by reference in their entirety.

BACKGROUND OF THE INVENTION

1. Field of the Invention

The present invention relates to a damper device (damper apparatus) which is provided on a liquid jetting apparatus, such as an ink jet printing apparatus, at an intermediate portion of a channel through which a liquid is supplied to a jetting head of the liquid jetting apparatus, and which reduces a pressure fluctuation in the liquid; a damper unit; a liquid jetting apparatus provided with the damper device; and a method of manufacturing damper device.

2. Description of the Related Art

As a printing apparatus of an ink jet type which is an example of a liquid jetting apparatus, a printing apparatus has been hitherto known having a structure in which an ink is supplied to a jetting head, which reciprocates while facing a recording paper, from an ink cartridge provided in a body of the apparatus (apparatus body), via a flexible ink supply tube (a so-called tube-supply type). In this printing apparatus, since inertial force acts on the ink inside the ink supply tube accompanied by the reciprocating movement of the jetting head, there is a possibility that a meniscus formed in a nozzle hole of the jetting head might not be maintained appropriately due to a pressure wave caused by the inertial force. Therefore, a damper device which is capable of changing the volume thereof by the pressure of the ink is arranged inside a carriage on which the jetting head is provided or mounted, at an intermediate portion of an ink supply channel arriving at the jetting head so as to attenuate the pressure wave acting on the ink at the damper unit.

On the other hand, in response to the demand in the recent years to make the printing apparatus be small or compact, there is a need to make the carriage etc. on which a jetting head is attached or mounted to have a small size. To respond to such a need, there is proposed a three-dimensional damper device for realizing a further small-sized damper device (see Japanese Patent Application Laid-open No. 2007-245484). In this damper device, a bag-shaped (pouch-shaped) elastic deformation member which temporarily stores an ink in the inside thereof is provided in a state that the elastic deformation member is attached to a substrate for each color ink, and this bag-shaped elastic deformation member is deformed three dimensionally based on the pressure of the ink.

However, in a case of this three-dimensional damper device, the shape of an opening of the bag-shaped elastic deformation member, at which the elastic deformation member is connected to the substrate, is limited (restricted) to a circular shape, and with the opening having the circular shape, it is difficult to realize a small-sized three-dimensional damper device as a whole, or it is difficult to realize a layout of ink supply channels to be connected to a plurality of pieces of the bag-shaped elastic deformation member for the inks of various colors respectively.

In other words, when the plurality of bag-shaped elastic deformation members are arranged in a row according to the color inks respectively, the dimension in a direction of arrangement becomes large (substantial) because a connecting portion between each of the bag-shaped elastic deformation members and the substrate is circular. On the other hand, it is possible to realize the small sizing by arranging the plurality of bag-shaped elastic deformation members in a matrix form with respect to the substrate. In this case, however, the layout becomes complicated as ink supply channels which are connected to the bag-shaped elastic deformation members intersect with each other.

Further, the bag-shaped elastic deformation member is a pre-produced molding product, and there are strict limitations on the outer shape and thickness thereof. Therefore, a method of manufacturing the bag-shaped elastic deformation member is not easy, and it is also not easy to secure characteristics (deformation characteristics with respect to the pressure) of each damper to be provided for each of the color inks, stably and at low cost.

SUMMARY OF THE INVENTION

In view of the above-described circumstances, an object of the present invention is to provide a damper device which is capable of exhibiting stable and high damper performance and in which the layout can be made simple for channels to be connected to the damper device. Further, in addition to this, another object of the present invention is to provide a damper device which is small-sized and easy to manufacture. Furthermore, still another object of the present invention is to provide a damper unit which is used in such damper device, and a method of manufacturing damper device. Further, another object of the present invention is to provide a liquid jetting apparatus provided with the damper device.

Moreover, an object of the present invention is to provide a damper device which is capable of stably exhibiting a high damper performance, with small dimensions. Furthermore, an object of the present invention is also to provide a damper device in which a layout of channels which are connected to the damper device is simple.

According to a first aspect of the present invention, there is provided a damper device which is provided on an intermediate portion of a channel supplying a liquid to a jetting head, and which reduces a fluctuation in a pressure of the liquid, the damper device including:

a storage chamber storing the liquid, and formed of: a substrate; a pair of supporting portions which are arranged to face each other in a predetermined facing direction, which project from the substrate, and peripheral portions of which have shapes substantially same with each other; and a film which is flexible and which has a sheet shape;

wherein the film is connected to the peripheral portions of the pair of supporting portions, and the storage chamber is formed as a space having a curved surface defined by the film.

According to a second aspect of the present invention, there is provided a damper unit which constructs a damper device provided on an intermediate portion of a channel supplying a liquid to a jetting head, the damper device including a storage chamber which stores the liquid and reducing a fluctuation in a pressure of the liquid, the damper unit including:

a substrate in which a part of the channel is formed; and a pair of supporting portions which are arranged to face each other, which project from the substrate, and of which peripheral portions have shapes substantially same with each other;

wherein the storage chamber is defined when a film which is flexible and which has a sheet shape is connected to the peripheral portions of the supporting portions.

In the damper device according to the first aspect of the present invention, and the damper unit according to the second aspect of the present invention, it is possible to change the volume of the storage chamber three-dimensionally by using the flexible film which has a sheet shape and which is easily available. Therefore, it is possible to realize a damper device and a damper unit which are capable of exhibiting high damper performance. Further, since the storage chamber is rectangular shaped in a plan view, even in a case of providing a plurality of pieces of the storage chamber, it is possible to arrange the storage chambers efficiently in a small area, thereby making it possible to simplify the layout of introducing routes or channels (ink-introducing routes). Furthermore, since the flexible member is used in a part of the damper device and the damper unit, it is possible to improve the response to change in the volume of the storage chamber with respect to the pressure fluctuation of the liquid. Moreover, in a case that the supporting portion includes an elastic wall, it is possible to restore the flexible member, which has been deformed, to the original form by the elastic force of the elastic wall, thereby making it possible to exhibit a stable damper performance. Further, since there is no restriction or limit to the shape of the storage chamber, it is possible to simplify the layout of introducing routes or channels which are connected to the storage chambers.

According to a third aspect of the present invention, there is provided a method of manufacturing a damper device which is provided at an intermediate portion of a channel supplying a liquid to a jetting head, and which reduces a fluctuation in a pressure of the liquid, the method including:

forming a damper unit having: a substrate in which a part of the channel is formed; and a pair of supporting portions which are arranged to face each other, which project from the substrate, and of which peripheral portions have shapes substantially same with each other; and forming a storage chamber by connecting a film, which is flexible and which has a sheet shape, to the peripheral portions of the supporting portions.

By providing such a construction, it is possible to manufacture a damper device which is capable of exhibiting high damper performance, the damper device having a storage chamber of which volume may be changed three dimensionally, by a simple step (process) of connecting the film to the pair of supporting portions.

According to a fourth aspect of the present invention, there is provided a liquid jetting apparatus including:

a liquid tank unit which stores a liquid, a jetting head in which a nozzle hole for jetting the liquid supplied from the liquid tank unit is formed; and the damper device according to the first aspect which is arranged between the liquid tank unit and the jetting head.

According to the present invention, it is possible to provide a damper device which is capable of stably exhibiting high damper performance, and in which the layout of channels which are connected to the damper device is simple; and further it is possible to provide a damper device which is small sized and easy to manufacture. Moreover, it is possible to provide a damper unit which is to be used in such a damper device, a liquid jetting apparatus such as a printing apparatus which includes such damper device, and a method of manufacturing damper device.

BRIEF DESCRIPTION OF THE DRAWINGS

FIGS. 7A and 7B are an enlarged view of an elastic wall and an enlarged view of a supporting edge portion, wherein FIG. 7A is a cross-sectional view taken along a line VIIa-VIIa of FIG. 4 and showing the elastic wall, and FIG. 7B is a cross-sectional view taken along a line VIIb-VIIb in FIG. 4 and showing the supporting edge portion;

FIGS. 8A and 8B are diagrams showing the structure of the elastic wall in further detail, wherein FIG. 8A is a rear view and FIG. 8B is a cross-sectional view taken along a line B-B of FIG. 8A;

FIGS. 9A and 9B are diagrams showing an elastic wall having a different structure, wherein FIG. 9A shows a perspective view and FIG. 9B shows a cross-sectional view taken along a line B-B of FIG. 9A;

DETAILED DESCRIPTION OF THE PREFERRED EMBODIMENTS

In the following, a damper device according to an embodiment of the present invention will be described below exemplified by a structure when used in an ink-jet printing apparatus (hereinafter, called as a "printing apparatus") having a jetting head, with reference to the accompanying drawings. In the following description, a direction in which the ink is jetted from the jetting head is defined as a downward direction (down direction, down), and a direction opposite to the direction of jetting is defined as an upward direction (up direction, up). A scanning direction of the jetting head is defined as a left-right direction, and direction orthogonal to both the up and down directions (the vertical direction) and the left-right direction is defined as a frontward direction (front direction, front) and a rearward direction (rear direction, rear). Moreover, the directions of "left", "right", "front" and "rear" are defined as shown in FIG. 1.

<Outline of the Structure of Printing Apparatus>

Figure 1:
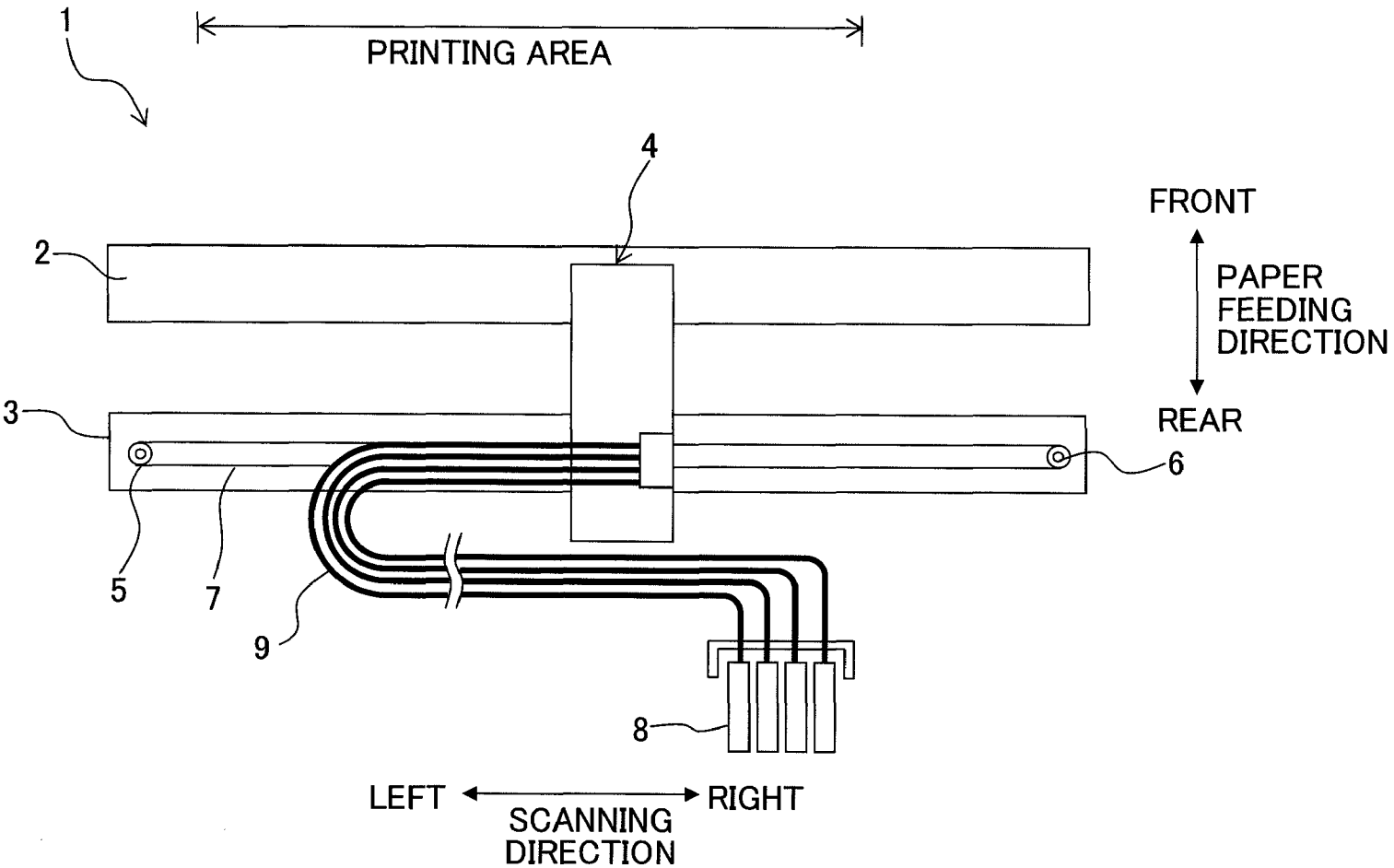
FIG. 1 is a schematic plan view showing main components of a printing apparatus according to an embodiment of the present invention.

As shown in FIG. 1, in the printing apparatus 1, a pair of guide rails 2 and 3 which are extended in the left-right direction is provided to be substantially parallel with each other, and a liquid supply unit 4 is supported, by the guide rails 2 and 3, to be slidable in the scanning direction, on the guide rails 2 and 3. A pair of pulleys 5 and 6 is provided in the vicinity of left-right end portions of the guide rail 3 respectively, and the liquid supply unit 4 is joined to (linked to) a timing belt 7 which is wound around the pulleys 5 and 6. A motor (not shown in the drawings) which drives and rotates the pulley 6 in a normal direction and a reverse direction is provided to the pulley 6. When the pulley 6 is driven and rotated by the motor in the normal direction and the reverse direction, the timing belt 7 reciprocates in the left direction and the right direction. With the reciprocating of the timing belt 7 in the left direction and the right direction, the liquid supply unit 4 is subjected to reciprocal scanning in the left-right direction along the guide rails 2 and 3.

In the printing apparatus 1, four ink cartridges 8 are detachably attached to be exchangeable. Further, four ink supply tubes 9 which are flexible are connected to the liquid supply unit 4, and inks of four colors (black, cyan, magenta, and yellow) are supplied to the liquid supply unit 4 from the four ink cartridges 8 respectively. A jetting head 15 (see FIG. 2) is provided on the liquid supply unit 4 at a lower portion of the liquid supply unit 4. At a position below or under the jetting head 15, the inks (liquids) are jetted from the jetting head 15 toward a recording body (recording medium) (such as a recording paper) which is transported in a direction perpendicular (orthogonal) to the scanning direction (paper feeding direction). In such a manner, it is possible to form an image on the recording medium.

Figure 2:
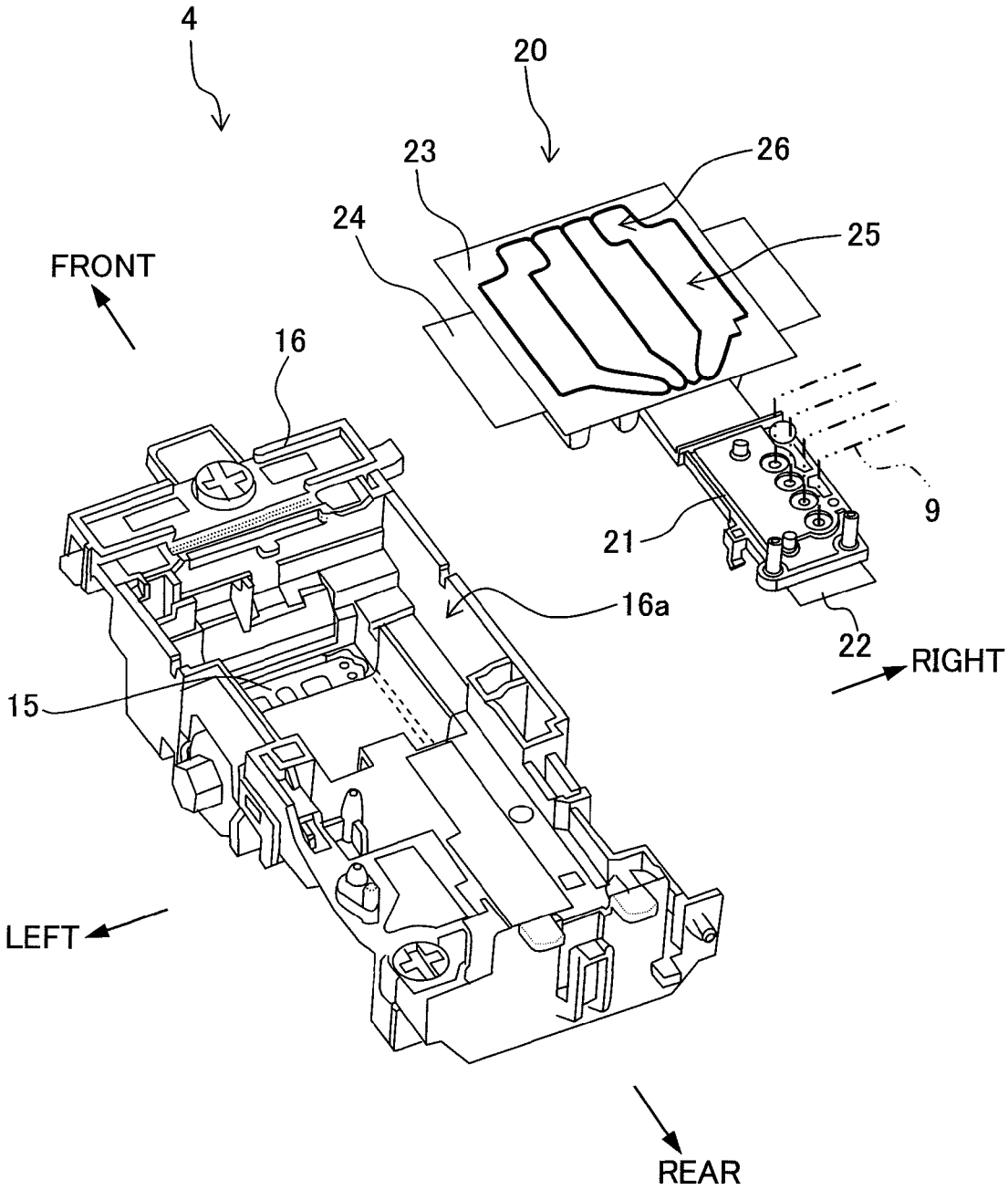
FIG. 2 is an exploded perspective view showing the structure of a carriage unit provided on the printing apparatus shown in FIG. 1.

As shown in FIG. 2, the liquid supply unit 4 includes a carriage case 16 which supports the jetting head 15, and a damper unit 20 on which the carriage case 16 is provided (attached, mounted) on mounted at a position above the jetting head 15. The carriage case 16 is box shaped which is long in the front and rear direction in a plan view. Further, an opening 16*a* is formed at an upper portion of the carriage case 16, and the damper unit 20 is attached via the opening 16*a*.

The damper unit 20 has a substrate (channel forming substrate) 21 which is a molding of resin, and is long in the front and rear direction; and a plurality of films 22, 23, and 24 each of which is in the form of a rectangular sheet and which are thermally welded or adhered to the substrate 21. The above-described ink supply tubes 9 are connected to a rear portion of the substrate 21. Further, a damper device (damper apparatus) 25 which reduces pressure fluctuation in the ink is provided at a front portion of the damper unit 20. Furthermore, a sub tank 26 which temporarily stores the ink is provided at a front side of the damper unit 20. The inks which are supplied to the damper unit 20 through the ink supply tubes 9, upon passing through the damper device 25 and the sub tank 26, are supplied to the jetting head 15. The structure of the damper unit 20 will be described below in further detail.

<Structure of Damper Unit (channel)>

Figure 3:
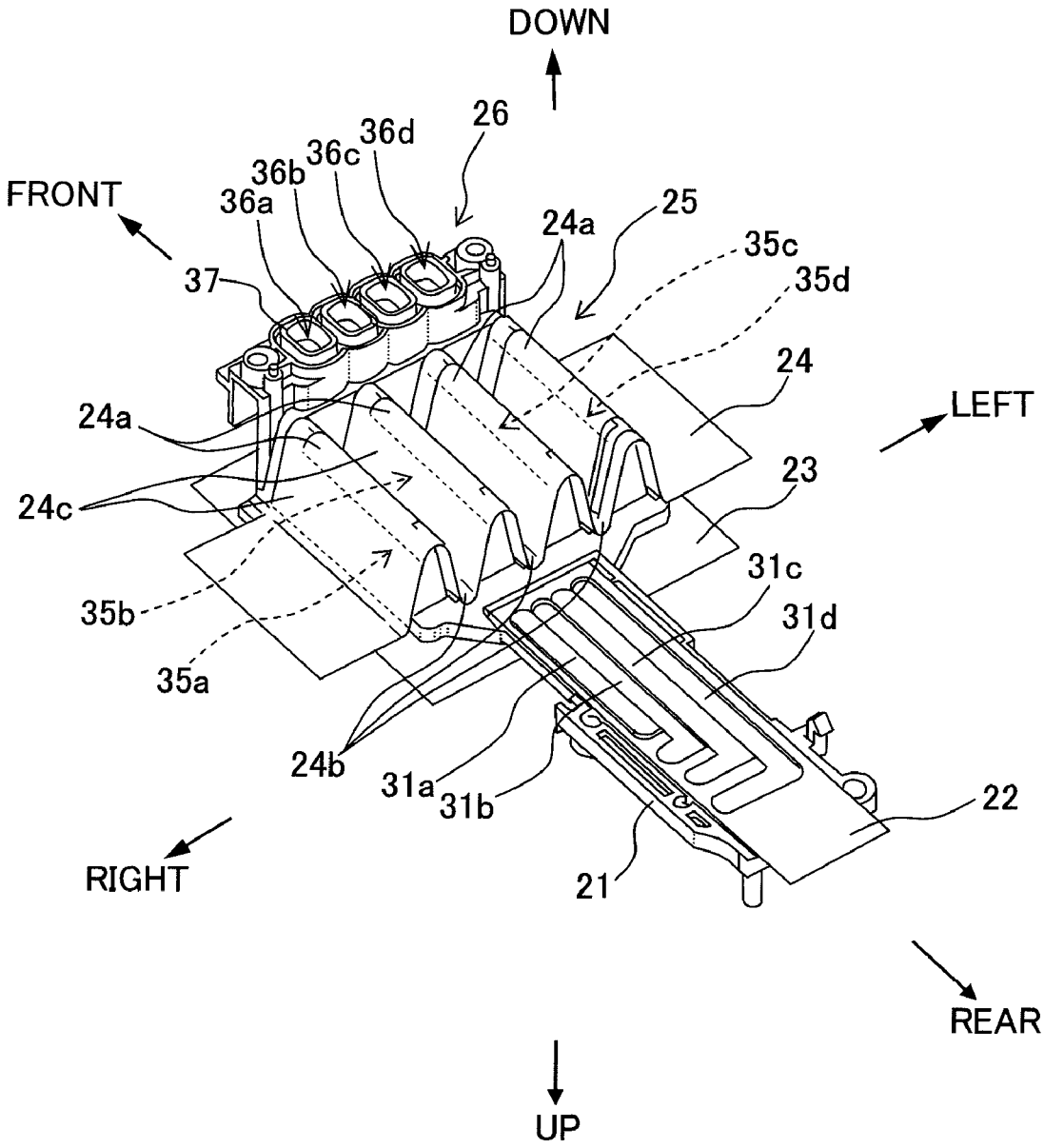
FIG. 3 is a perspective view of a damper unit provided on the carriage unit shown in FIG. 2, as seen from therebelow.
Figure 4A:
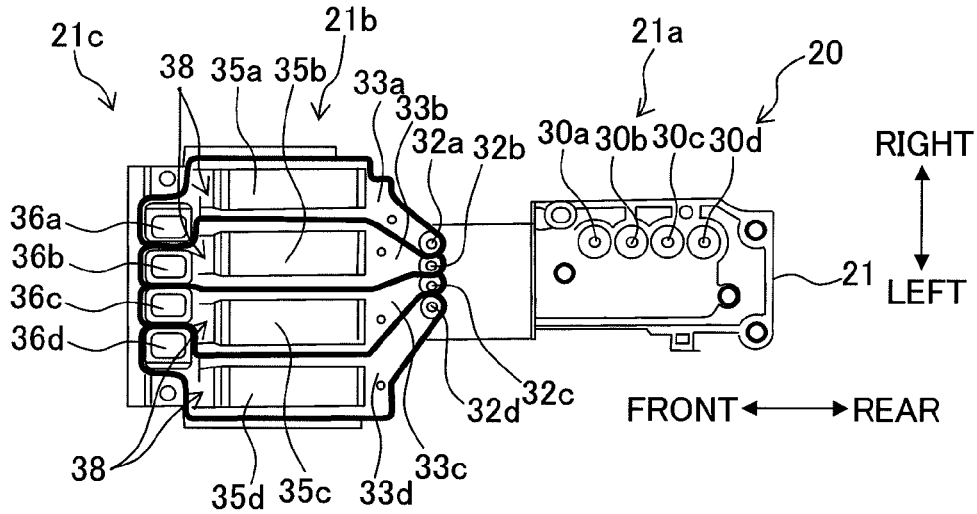
FIGS. 4A to 4C are a plan view, a side view, and a bottom view respectively of the damper unit, wherein a film is omitted in the drawings.
Figure 4B:
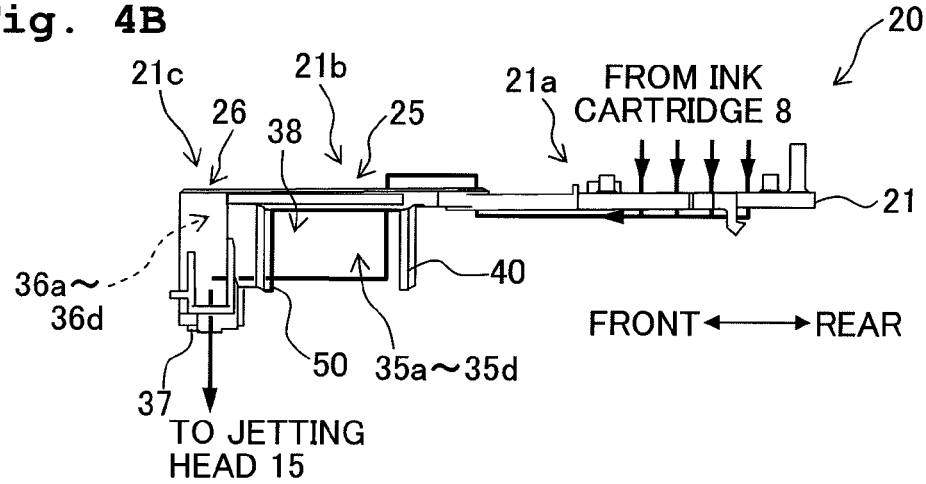
Figure 4C:
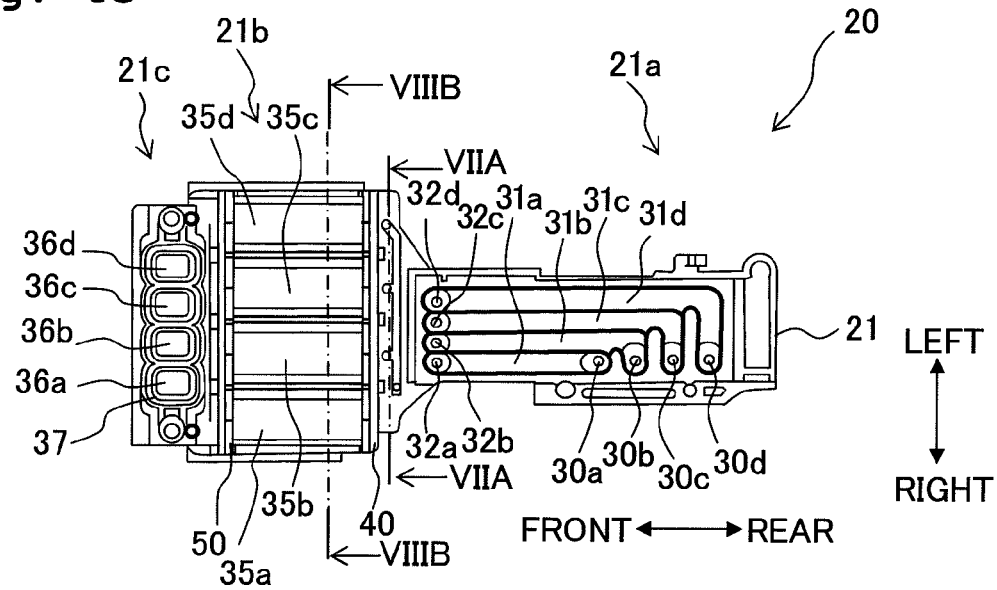

In FIGS. 4A, 4B and 4C, the films 22 to 24 are omitted. As shown in FIGS. 3 and 4 (4A to 4C), the substrate 21 of the damper unit 20 includes a channel forming portion 21*a* which is positioned at a rear portion, a damper forming portion 21*b* which is positioned at a front side of the channel forming portion 21*a*, and a tank forming portion 21*c* which is positioned at further front side of the damper forming portion 21*b*. The width (length in the left-right direction) of the channel forming portion 21*a* is smaller than the widths of the damper forming portion 21*b* and the tank forming portion 21*c*.

As shown in FIGS. 4A, 4B and 4C, four supply tube connecting holes 30*a*, 30*b*, 30*c*, and 30*d* which are formed penetrating through the channel forming portion 21*a* in the up and down direction at a right-side portion which is located at the rear side of the channel forming portion 21*a* such that the supply tube connecting holes 30*a* to 30*d* are arranged to be aligned in a row in the front and rear direction. Moreover, four bypass holes 32*a*, 32*b*, 32*c*, and 32*d* are formed penetrating through the channel forming portion 21*a* in the up and down direction, at a front end portion of the channel forming portion 21*a*. The bypass holes 32*a* to 32*d* are arranged in a row in the left-right direction. The ink supply tubes 9 extended from the ink cartridges 8 are connected to the supply tube connecting holes 30*a* to 30*d*.

As shown in FIG. 4C, four grooves in the form of a recess dented upward (dented in the up direction) are formed on a side of the bottom surface of the channel forming portion 21*a*, and the bottom surface of the channel forming portion 21*a* is covered by a film 22 (see FIG. 3). Accordingly, four ink introducing channels 31*a*, 31*b*, 31*c*, and 31*d* extending from the supply tube connecting holes 30*a* to 30*d* up to the bypass holes 32*a* to 32*d* are formed. The ink introducing channel 31*a* is extended to be straight in the front direction from the supply tube connecting hole 30*a* positioned at the frontmost position, and communicates with the bypass hole 32*a* positioned at the right-side end. The ink introducing channel 31*b* is extended from the supply tube connecting hole 30*b* positioned at the rear side of the supply tube connecting hole 30*a*. The ink introducing channel 31*b* is extended toward the left side in order to bypass the supply tube connecting hole 30*a* and the ink introducing channel 31*a* described above, and then is bent at an intermediate portion of the ink introducing channel 31*b* to be directed in the front direction, and communicates with the bypass hole 32*b* which is adjacent to the bypass hole 32*a*. The ink introducing channels 31*c* and 31*d* are extended from the supply tube connecting holes 30*c* and 30*d* respectively positioned at a further rear side of the supply tube connecting hole 30*b*. Similarly as the above-described ink introducing channel 31*b*, the ink introducing channels 31*c* and 31*d* are extended toward the left side and then are bent to be directed in the front direction, and communicate with the bypass holes 32*c* and 32*d*, respectively. In this manner, the ink introducing channels 31*a* to 31*b* extending from the tube connecting holes 30*a* to 30*d* to the bypass holes 32*a* to 32*d*, respectively, are laid out such that the routes of the ink introducing channels 31*a* to 31*d* do not intersect with each other.

As shown in FIG. 4A, grooves communicating individually with the four bypass holes 32*a* to 32*d* respectively are formed in the upper surface of the damper forming portion 21*b* of the substrate 21; and the upper surfaces of the damper forming portion 21*b* and the tank forming portion 21*c* are covered by the film 23 (see FIG. 3). With this, ink connecting channels 33*a*, 33*b*, 33*c* and 33*d* which are extended in the front direction are formed. Each of the ink connecting channels 33*a* to 33*d* have a width which is increased toward the front direction; and the ink connecting channels 33*a* to 33*d* communicate with upper portions of four ink storage chambers 35*a*, 35*b*, 35*c* and 35*d* respectively, which are formed at a front portion of the damper forming portion 21*b*.

As shown in FIG. 3, the ink storage chambers 35*a* to 35*d* are covered by the films 23 and 24 from the up and down direction, thereby forming the damper device 25. Further, a cross-section of the damper device (the ink storage chambers 35*a* to 35*d*), which is orthogonal to the front and rear direction, is substantially inverted-triangular shaped, and the overall shape or contour of the damper device (the ink storage chambers 35*a* to 35*d*) is in the form of a substantial triangular pole (triangular prism) extended in the front and rear direction. The ink storage chambers 35*a* to 35*d* are arranged to be aligned from the right side to the left side of the damper forming portion 21*b*.

The sub tank 26 which includes four tank chambers 36*a*, 36*b*, 36*c*, and 36*d* formed in the tank forming portion 21*c* is provided at a front side of the ink storage chambers 35*a* to 35*d*. The tank chambers 36*a* to 36*d* are arranged in a row from the right side to the left side of the tank forming portion 21*c*, and upper portions of the tank chambers 36*a* to 36*d* are covered by the film 23, together with the ink storage chambers 35*a* to 35*d*. Further, upper-portion spaces of the ink storage chambers 35*a* to 35*d* and upper-portion spaces of the tank chambers 36*a* to 36*d*, which corresponding to the ink storage chambers 35*a* to 35*d*, mutually communicate respectively. Moreover, as shown in FIG. 3, a seal member 37 (see also FIG. 5) in which four holes communicating with the tank chambers 36*a* to 36*d* are formed is attached to a lower portion of the sub tank 26. When the damper unit 20 is attached to the carriage case 16 (see FIG. 2), a lower end of the seal member 37 is connected to the jetting head 15.

In the above-described damper unit 20, as shown in FIGS. 4A to 4C, the inks from the ink supply tubes 9 are supplied from a side of the upper surface of the substrate 21; and the supplied inks are guided from the supply tube connecting holes 30*a* to 30*d* to the supply bypass holes 32*a* to 32*d* via the ink introducing channels 31*a* to 31*d* on the side of the lower surface of the substrate 21, and are further made to pass through the ink connecting channels 33*a* to 33*d* on the side of the upper surface of the substrate 21 via the supply bypass holes 32*a* to 32*d*, and are introduced or poured into the ink storage chambers 35*a* to 35*d* respectively of the damper device 25. Furthermore, the ink inside each of the ink storage chambers 35*a* to 35*d* is guided to one of the tank chambers 36*a* to 36*d*, which are communicating with the ink storage chambers 35*a* to 35*d* at the upper portions thereof, is directed to a lower portion of one of the tank chambers 36*a* to 36*d*, and then is supplied to the jetting head 15 (see FIG. 2) connected to one of the tank chambers 36*a* to 36*d* via the seal member 37. While the ink is supplied, when a pressure of the ink is varied or fluctuated due to the liquid supply unit 4 being subjected to the scanning, etc., the pressure fluctuation is alleviated or suppressed by the damper device 25.

<Structure of Damper Unit>

Figure 5:
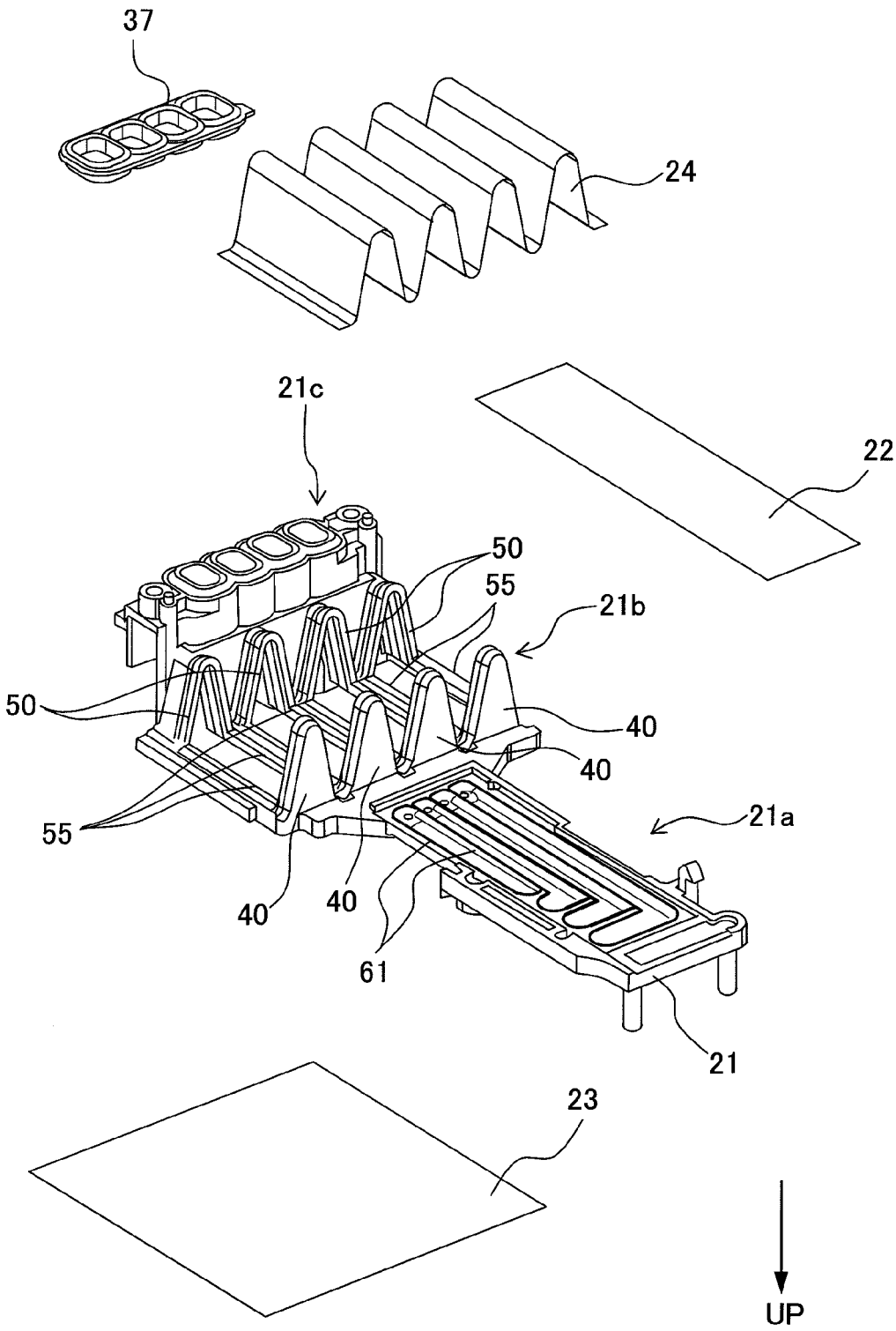
FIG. 5 is a diagram for explaining the structure of the damper device, and is an exploded perspective view of the damper unit as seen from therebelow.
Figure 6:
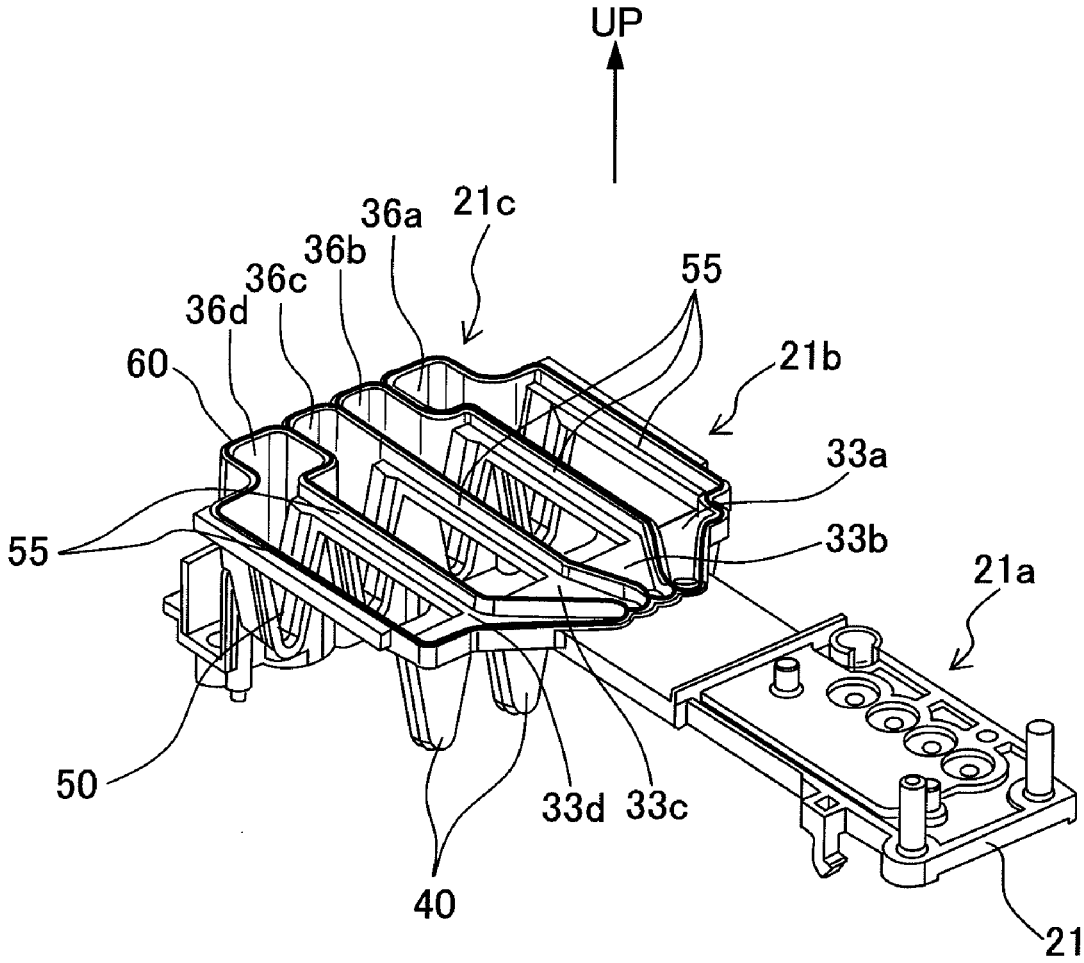
FIG. 6 is a perspective view of a substrate constructing the damper unit, as seen from thereabove.

As shown in FIGS. 5 and 6, four elastic walls (support portions) 40 having a substantially triangular shape are provided on the lower surface of the damper forming surface 21*b* of the substrate 21 forming the damper unit 20. The elastic walls 40 are arranged in a row in the left-right direction such that the normal direction thereof coincides with the front and rear direction. Four supporting edge portions (supporting portions) 50 are provided at a position in front of the elastic walls 40 such that the supporting edge portions 50 face the elastic walls 40 and that the supporting edge portions 50 are located at positions separated by a predetermined distance from the elastic walls 40 respectively. In other words, the elastic walls 40 and the supporting edge portions 50 are arranged on the lower surface of the damper forming portion 21*b* to form pairs of the elastic wall and supporting edge portion so as to face each other in the front and rear direction. Four such pairs each including one of the elastic walls 40 and one of the supporting edge portions 50 are arranged to be aligned in parallel in the left-right direction.

Figure 7A:
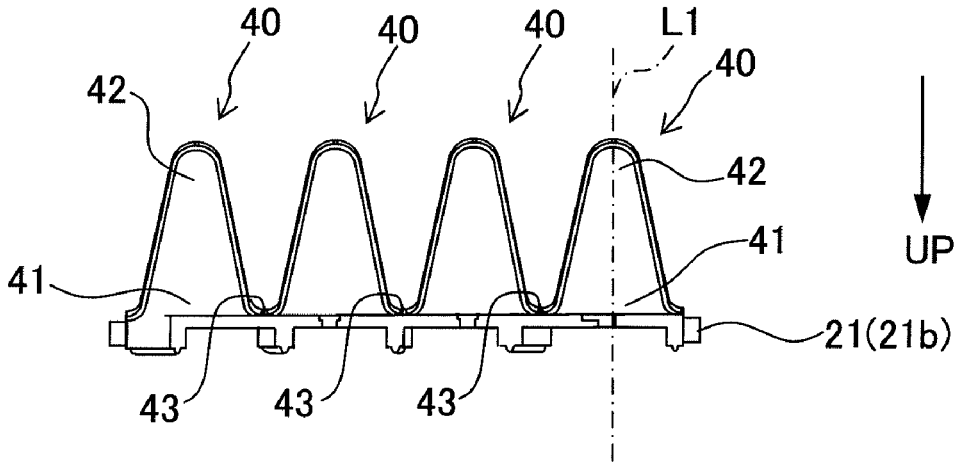
Figure 7B:
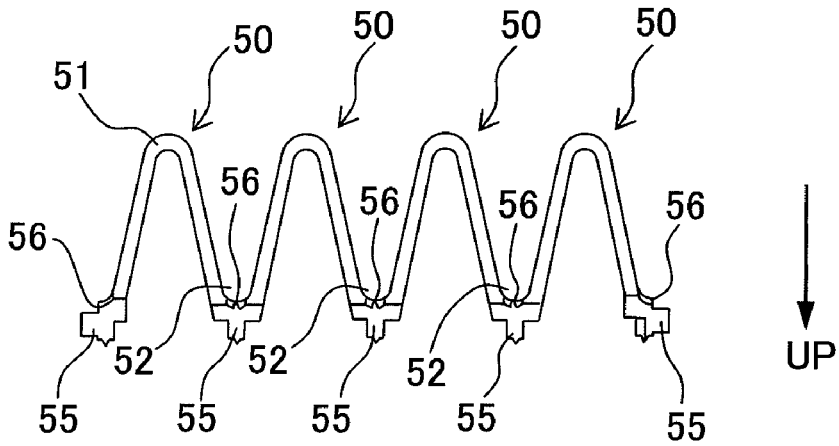
Figure 8A:
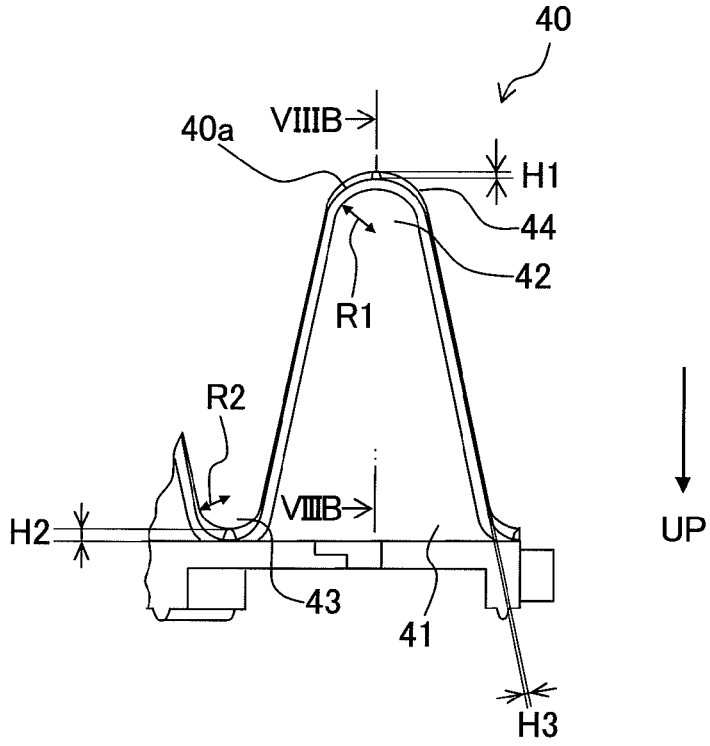

As shown in FIG. 7A, all the elastic walls 40 have a same shape. Specifically, the shape of each of the elastic walls 40 is a substantially triangular shape in which a base portion 41 connected to the substrate 21 is the base, and an end portion farthest from the substrate 21 is an apex portion 42. Further, each of the elastic walls 40 is bilaterally symmetrical with respect to a virtual line L1 in the up and down direction connecting the base portion 41 and the apex portion 42. Further, the apex portion 42, as seen in a rear view, is rounded to be circular arc shaped and protruding upward, and a recess-shaped connecting portion 43 having a circular arc shape dented upward (recessed or dented in the up direction) is formed between the base portions 41, 41 of the adjacent elastic walls 40. Further, as shown in FIG. 8A, a radius of curvature R1 of the outer peripheral shape of such apex portion 42 is greater than a radius of curvature R2 of the outer peripheral shape of the recess-shaped connecting portion 43. On the other hand, as shown in FIG. 7B, each of the supporting edge portion 50 has a substantially same shape as a peripheral portion 40*a* of the above-described elastic wall 40, and has the apex portion 51 and the recess-shaped connecting portion 52 similar to the apex portion 42 and the recess-shaped connecting portion 43 respectively. In this manner, since the recess-shaped connecting portion 43 has the radius of curvature smaller than the radius of curvature of the apex portion 42 (R2<R1), it is possible to secure the area of the elastic wall 40 (namely, cross-sectional area of the ink storage chambers 35*a* to 35*d*) to be large (substantial). Further, since it is possible to arrange the elastic walls 40 closely, it is possible to suppress the arrangement area therefor.

Figure 8B:
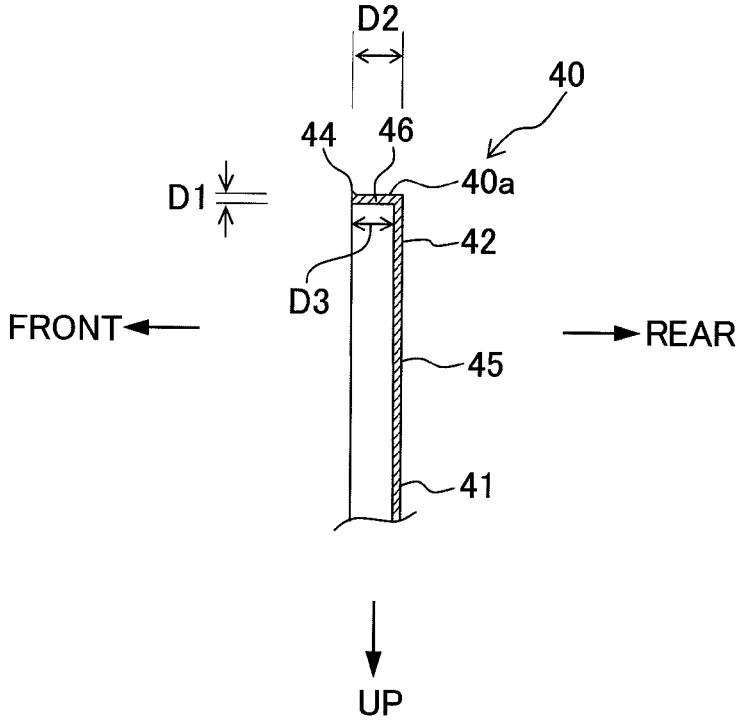

To explain the structure of the elastic walls 40 in detail, as shown in FIG. 8B, each the elastic walls 40 includes a protruding wall portion 45 which is formed to protrude on the substrate 21, and a flange portion 46 which is formed to be wide and extending along edge of the protruding wall portion 45. The thickness of the protruding wall portion 45 is smaller than the thickness of the substrate 21, and is comparatively easy to be deformed in an elastic deformation area by the action of external force. The flange portion 46, which is formed to have a belt shape and to have a substantially constant thickness D1 and a predetermined width D2, is connected to the edge of the protruding wall portion 45, and the flange portion 46 is protruded from the protruding wall portion 45 in the front direction (namely, toward the supporting edge portion 50) by only a length D3.

Further, as shown in FIG. 8A, a projection 44 which is extended along the peripheral portion 40*a* is provided on the peripheral portion 40*a* which corresponds to the outer surface of the flange portion 46 in the elastic wall 40. This projection 44 has various functions, including a function as a binder upon welding or adhering the film 24 with a manufacturing method which will be described later. Further, as shown in FIG. 8B, the projection 44 is projected from a front-end portion of the flange portion 46 (in other words, an end portion on the side of the supporting edge portion 50), and is formed such that a projection amount (projection dimension) of the projection 44 changes depending on a position at the peripheral portion 40*a*. More specifically, the projection 44 has relatively (comparatively) large dimensions H1 and H2 at the apex portion 42 and the recess-shaped connecting portion 43, and has a smallest dimension H3 at a central portion located between the apex portion 42 and the recess-shaped connecting portion 43. Further, the shape of the projection 44 along the edge portion thereof substantially coincides with the peripheral portion 40*a* of the elastic wall 40. In other words, the edge portion of the projection 44 is located at a position at which the peripheral portion 40*a* of the elastic wall 40 is shifted slightly (to a small extent) in a direction of separating the peripheral portion 40*a* away or apart from the substrate 21 (in the down direction). In this embodiment, the construction is shown, as an example, in which the projection 44 as described above is not provided on the supporting edge portion 50. However, it is allowable to provide a structure similar to the projection 44 on the supporting edge portion 50.

As shown in FIGS. 5 and 6, cross-linking ribs (cross-bridge ribs) 55 extended in the front and rear direction are provided each between the recess-shaped connecting portion 43 between the adjacent elastic walls 40 and the recess-shaped and connecting portion 52 between the supporting edge portions 50 and corresponding to the recess-shaped connecting portion 43. Further, similar cross-linking ribs 55 (see also FIG. 7B) are also provided each between an outer-side end portion in the left-right direction of the base portion 41 of one of the elastic walls 40 positioned at the left and right ends and an end portion of one of the supporting edge portions 50 which corresponding to the outer-side end portion in the left-right direction of one of the elastic walls 40 positioned at the left and right ends. Accordingly, in this embodiment, the four elastic walls 40 and the four supporting edge portions 50 are connected or linked by the five cross-linking ribs 55 in total. Further, as shown in FIG. 7B, another projections 56 each of which is extended over an entire area between one of the elastic walls 40 and one of the supporting edge portions 50 is formed to project on the lower surface of the cross-linking rib 55. As will be described later, the projections 56 also functions as a binder at the time of welding the film 24, similarly as the projections 44 described above.

As shown in FIG. 6, on the upper surface of the substrate 21, a connecting edge portion 60 with the film 23 is formed along the upper surfaces of peripheral portions of the ink connecting channels 33*a* to 33*d*, the upper surfaces of the cross-linking ribs 55, and the upper surface of a wall portion which partitions the tank chambers 36*a* to 36*d*. The connecting edge portion 60 is formed to be positioned in substantially a same plane throughout the entire length thereof. Moreover, as shown in FIG. 5, also on the lower surface of the substrate 21, a connecting edge portion 61 with the film 22 is formed along the peripheral edge portions of the ink introducing channels 31*a* to 31*d* (see FIG. 4); and the connecting edge portion 61 also is formed to be positioned in substantially a same plane throughout the entire length thereof.

In this embodiment, the film 24 which is a flexible member in the form of a rectangular sheet is thermally welded or adhered to the above-described elastic walls 40, supporting edge portions 50, and cross-linking ribs 55 by a predetermined procedure, and the film 23 is thermally welded or adhered to the connecting edge portion 60 on the upper surface of the substrate 21. Accordingly, the damper device 25 (see FIG. 3) having the ink storage chambers 35*a* to 35*d* surrounded by the films 23, 24, the elastic walls 40, and the supporting edge portion 50*s* is formed; and at the same time, the sub tank 26 having the tank chambers 36*a* to 36*d* is also formed. Moreover, the film 22 is thermally welded also to the connecting edge portion 61 of the lower surface of the substrate 21 to thereby form the ink introducing channels 31*a* to 31*d*.

In the damper device 25 formed in this manner, the shape of each of the ink storage chambers 35*a* to 35*d* forms a substantially triangular-pillar shape extended in the front and rear direction that is an alignment direction in which the elastic walls 40 and the supporting edge portions 50 forming the pairs respectively are aligned. Further, a cross section of each of the ink storage chambers 35*a* to 35*d* orthogonal to the axial direction thereof (in other words, the alignment direction in which the elastic walls 40 and the supporting edge portions 50 forming the pairs respectively are arranged) is a triangular shape (inverted-triangular shape in a posture when being used, as shown in FIG. 2) which is similar to that of the elastic wall 40, with respect to the cross section at any location in the axial direction. Moreover, each of the ink storage chambers 35*a* to 35*d* is formed as a space having a curved surface which is defined by the film 24. Specifically, as shown in FIG. 3, a ridge portion 24*a* having a circular-arc shaped cross section having a curved surface, which is defined by the film 24, is formed at a portion connecting the apex portions 42 and 51 of each of the elastic walls 40 and each of the supporting edge portions 50; and a trough portion 24*b* having a circular-arc shaped cross-section having a curved surface, which is defined by the film 24, is formed at a portion connecting the recess-shaped connecting portions 43, 52 of each of the elastic walls 40 and each of the supporting edge portions 50. Among these ridge and trough portions, the trough portions 24*b* are fixed to the cross-linking ribs 55 by welding so that the inks are prevented from being mixed between the adjacent ink storage chambers 35*a* to 35*d*; and the ridge portions 24*a* are not welded to the substrate 21 etc. so that the ridge portions 24*a* are capable of exhibiting flexibility.

Consequently, in such a damper device 25, when the pressure is fluctuated inside the ink storage chambers 35*a* to 35*d* and the negative pressure is generated, the ridge portion 24*a* and a side-wall surface 24*c* between the ridge portion 24*a* and the trough portion 24*b* (see FIG. 3) in the film 24 are deformed and bent (flexed) inward, and thus the ink storage chambers 35*a* to 35*d* are deformed three dimensionally, and the volumes thereof are changed. Further, such deformation of the film 24 has a favorable response with respect to the pressure fluctuation since the film 24 is made of a flexible member, and it is possible to exhibit high damper performance. At this time, with the deformation of the film 24, the apex portion 42 of the elastic wall 40 is also bent inward with respect to the base portion 41, the elastic wall 40 is also deformed with a favorable response because the protruding wall portion 45 of the elastic wall 40 is made to be thin. Further, when the negative pressure is relieved, it is possible to restore the film 24 promptly to the original state by the elasticity of the elastic wall 40.

On the other hand, as already described above, the upper portion spaces of the ink storage chambers 35*a* to 35*d* and the upper portion spaces of the tank chambers 36*a* to 36*d* are communicated with each other respectively, and uppermost portions in these upper portion spaces each form an air storage chamber 38 (see the plan view and the side view shown in FIGS. 4A and 4B). Consequently, it is possible to secure a substantial (large) space for trapping and storing the air existing in the ink. Further, since an upper portion of the air storage chamber 38 is covered by the film 23, and the inner surface of the air storage chamber 38 is flat without any unevenness (projections and recesses, irregularity), the air is hardly trapped. Consequently, when an construction (a structure) is provided such that the air in the air storage chamber 38 is discharged by an air discharge mechanism which is provided separately at an outside, it is possible to improve the efficiency of air discharge.

Further, in the damper device 25 according to the embodiment, each of the ink storage chambers 35*a* to 35*d* has a rectangular shape having a long dimension in the front and rear direction in a plan view, and the ink storage chambers 35*a* to 35*d* are aligned in the left-right direction. Accordingly, it is possible to arrange the ink storage chambers 35*a* to 35*d* efficiently in a small area without forming a gap as much as possible, as seen in a plan view. Further, since the arrangement directions of the bypass holes 32*a* to 32*d* and of the ink storage chambers 35*a* to 35*d*, and of the tank chambers 36*a* to 36*d* are all unified in the left-right direction, it is possible to simplify the layout of routes or paths communicating the respective holes and chambers, without making the routes being intersected with each other. Further, since the longitudinal direction (front and rear direction) of the ink storage chambers 35*a* to 35*d* is orthogonal to the scanning direction (left-right direction) of the damper unit 20, it is possible to suppress the air inside the air storage portion 38, located at the upper portion of the ink storage chambers 35*a* to 35*d*, from being directed to the jetting head 15 due to the inertial force in the left-right direction acting on the ink at the time of scanning. Further, such entry of the air into the jetting head 15 is suppressed even more efficiently by making the route (path) of the ink channel communicating inflow ports (on the side of the bypass hole) of the ink via which the ink inflows into the ink storage chambers 35*a* to 35*d* and outflow ports (on the side of the tank chamber) be orthogonal to the scanning direction.

<Modification of Elastic Wall>

Figure 9A:
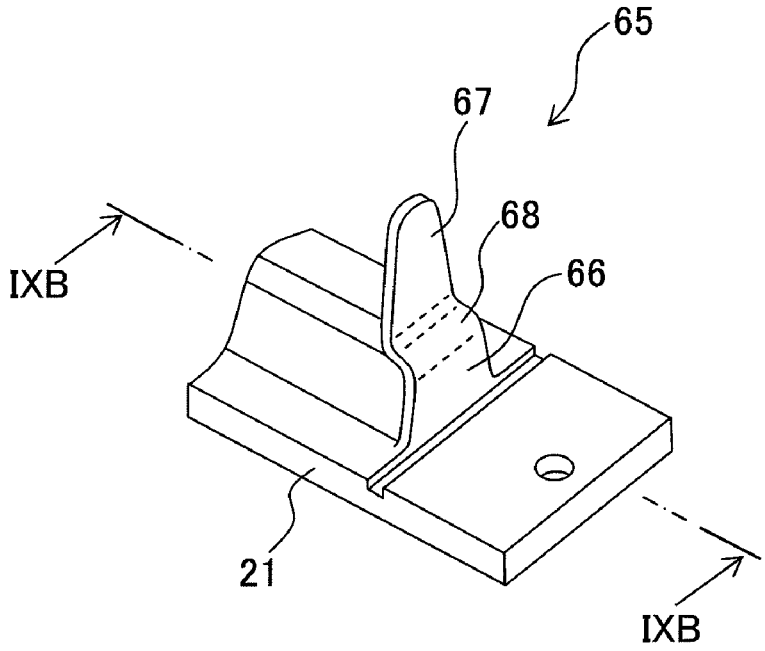
Figure 9B:
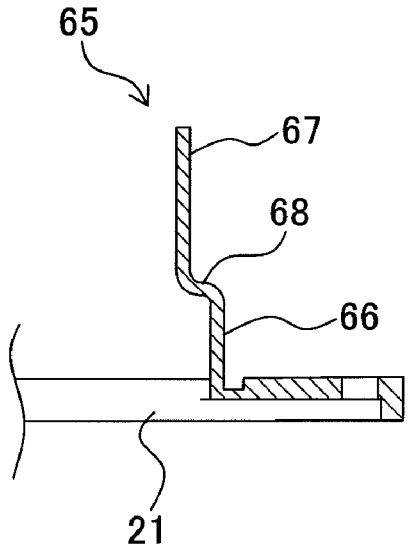

Note that the structure of the elastic wall 40 is not limited to the above-described structure. FIGS. 9A and 9B are diagrams showing an elastic wall 65 having a structure different from that of the above-described elastic wall 40, wherein FIG. 9A shows a perspective view and FIG. 9B shows a cross-sectional view taken along a line B-B. As shown in FIGS. 9A and 9B, the elastic wall 65 has a substantially triangular shape in a rear view, and has a structure in which an apex portion 67 separated farthest from the substrate 21, with respect to a base portion 66 connected to the substrate 21, is offset at an intermediate portion of the elastic wall 65 such that the apex portion 67 is positioned on the side of front as seen in a side view. To describe more specifically, the base portion 66 is arranged to project substantially perpendicularly with respect to the substrate 21, and an intermediate wall portion 68, which is extended by only a small amount or dimension in the front direction, is connected to a front end of the base portion 66. Further, at a front-end portion of the intermediate wall portion 68, the apex portion 67 is formed to extend in a direction of separating away from the substrate 21.

In a case of such elastic wall 65, it is possible to secure a large or substantial route length (path length) from the base portion 66 and up to the apex portion 67 (in other words, a dimension in which the length dimensions of the base portion 66, the intermediate wall portion 68, and the apex portion 67 are added). As a result, it is possible to deform the elastic wall 65 more greatly by an external force acting on the apex portion 67. Consequently, in a case that the elastic wall 65 is used in the damper device 25 and when the film 24 is deformed due to the pressure fluctuation in the ink storage chambers 35*a* to 35*d*, then the elastic wall 65 is also easily deformed accompanying with the deformation of the film 24. Therefore, it is possible to further improve, regarding the ink storage chambers 35*a* to 35*d*, the response to the change in the volume of the ink storage chambers 35*a* to 35*d* caused by the pressure fluctuation.

<Method of Manufacturing Damper Device>

Next, an explanation will be given about a method of manufacturing the above-described damper device 25, in particular, about a procedure for forming the ink storage chambers 35*a* to 35*d* by welding the film 24 to the substrate 21.

Figure 10:
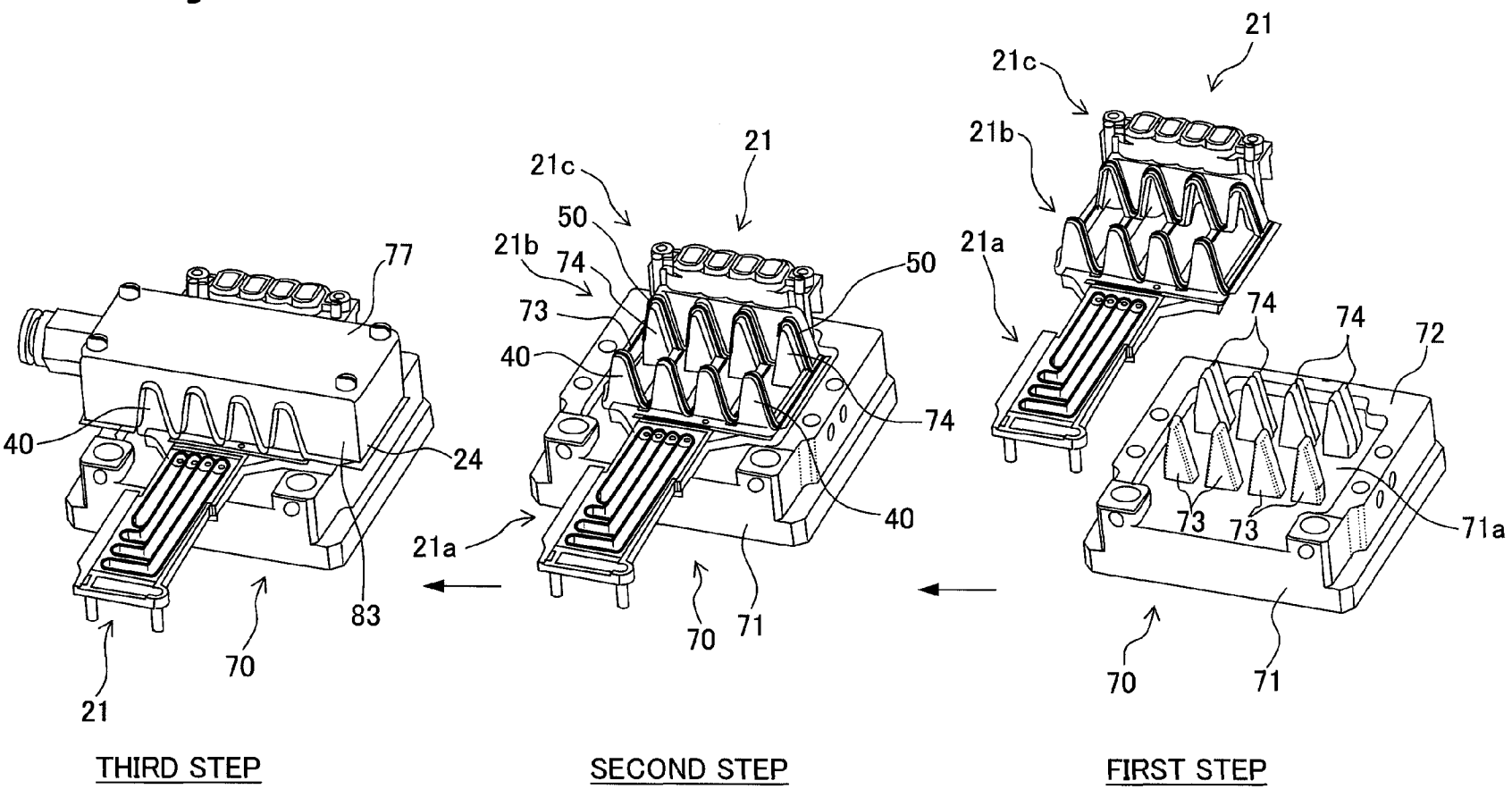
FIG. 10 is a diagram for explaining a method of manufacturing of the damper device while dividing the method into first to sixth steps, and shows the first to third steps, up to setting of a film on the substrate.

As shown in FIG. 10, in the first step of the method of manufacturing, the substrate 21 is arranged by reversing the posture when in use (see FIG. 2) in a upside-down manner, and a jig 70 which supports the damper forming portion 21*b* of the substrate 21 from therebelow is prepared. The jig 70 includes a base 71 in the form of a block having a substantially square shape in a plan view, and a supporting wall portion 72 is provided on an upper surface of the base 71 at the three side of the upper surface 71. Consequently, an upper portion of the base 71 is covered on its three sides by the supporting wall portions 72, and the remaining one side thereof is open, thereby forming, in a central portion of the base 71, a recess 71*a* on which the substrate 21 is placed or arranged. The recess 71*a* has a shape which matches substantially with the shapes in the plan view of the damper forming portion 21*b* and the tank forming portion 21*c* of the substrate 21, and a base surface of the recess 71*a* is flat.

Further, first and second supporting projections 73, 74 are formed to project from the recess 71*a*. The first supporting projection 73 is a member for supporting the elastic wall 40 from therebelow (from the inner side of the ink storage chambers 35*a* to 35*d*), and four pieces of the first supporting projection 73 are aligned at positions corresponding to the elastic walls 40. Further, the external shape or contour of each of the first supporting projections 73 is a shape matching with an inner-surface shape of the elastic wall 40, and specifically, is substantially a triangular shape having a predetermined thickness greater than the projection amount or dimension D3 of the flange portion 46 (see FIG. 8) such that the inner surface of the protruding wall portion 45 and the inner surface of the flange portion 46 make a close contact with a satisfactory matching. On the other hand, the second supporting projection 74 is a member for supporting the supporting edge portion 50 from therebelow, and four pieces of the second supporting projection 74 are aligned at positions corresponding to the supporting edge portions 50 so as to face the supporting edge portions 50. Each of the second supporting projections 74 has a substantially triangular shape having a predetermined thickness to make a close contact with the inner surface of one of the supporting edge portions 50 with a satisfactory matching.

In the second step, the substrate 21 is placed on the above-described jig 70 from above the jig 70. At this time, the damper forming portion 21*b* and the tank forming portion 21*c* of the substrate 21 are fitted into the recess 71*a* of the jig 70, and is supported by being surrounded by the supporting wall portions 72 from the three sides. Here, the channel forming portion 21*a* is in a state of sticking out from the jig 70. Further, the flanges 46 of the elastic walls 40 and the supporting edge portions 50 are brought in contact, from therebelow (from the inner side thereof), with the first supporting projections 73 and the second supporting projections 74 respectively and thus are supported by the first supporting projections 73 and the second supporting projections 74 respectively.

Since the elastic walls 40 and the supporting edge portions 50 are supported by the first supporting projections 73 and the second supporting projections 74 in this manner, even when there is a slight dimensional error in the elastic walls 40 and the supporting edge portions 50 of the substrate 21 during molding, it is possible to correct such dimensional error to an appropriate shape in a state that the elastic walls 40 and the supporting edge portions 50 are supported by the first supporting projections 73 and the second supporting projections 74.

In the third step, the film 24 is set with respect to the substrate 21 supported by the jig 70. At this time, the film 24 is sucked by a suction unit 77, and is arranged on the substrate 21 in a state that the film 24 is maintained in a waveform (form of a wave) having a predetermined curved shape.

Figure 12:
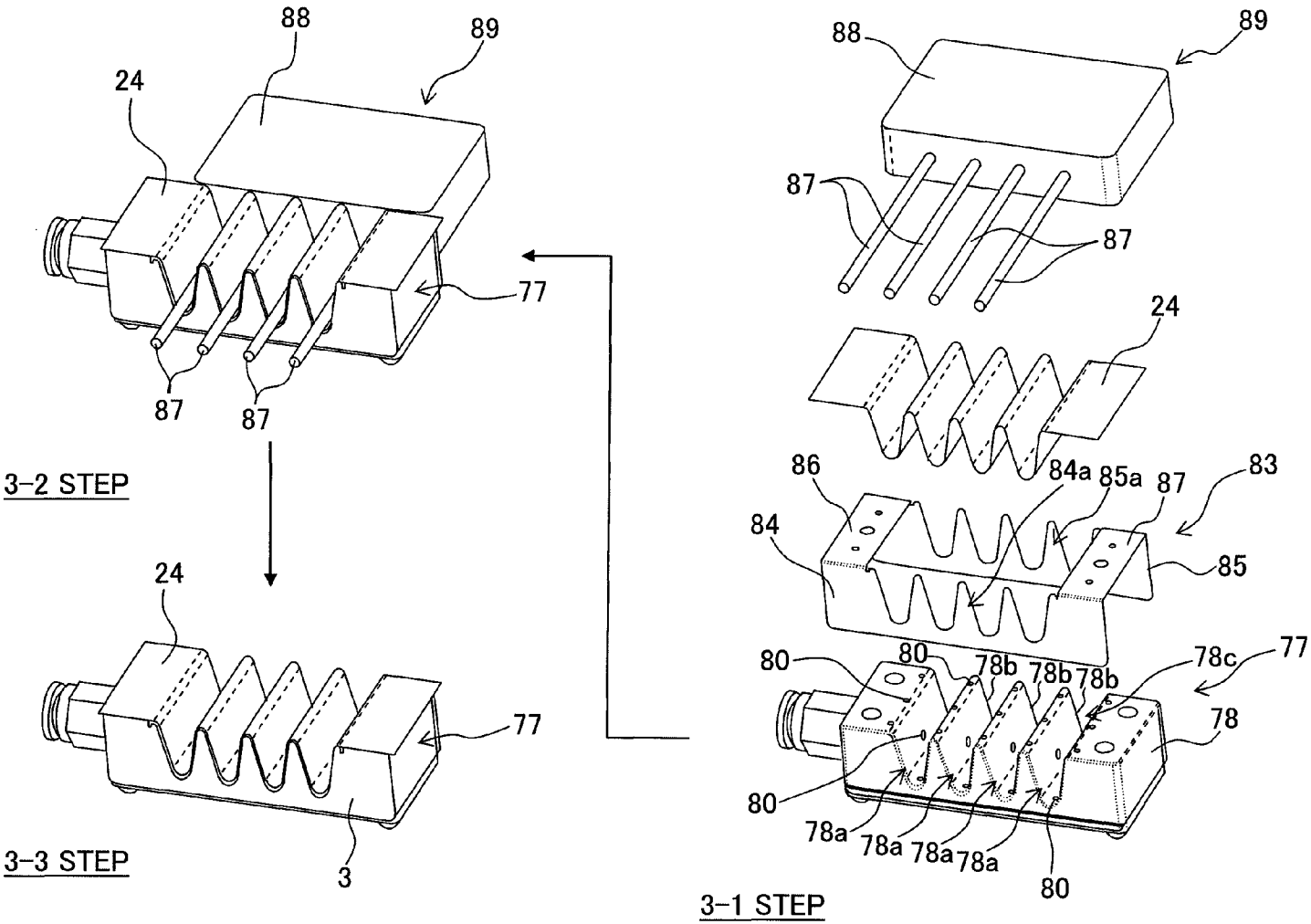
FIG. 12 is a diagram for explaining a process (step) of attaching the film by suction to a suction unit used at the third step.

As shown in a 3-1 step (third-first step) in FIG. 12, the suction unit 77 includes a hollow suction box 78 having a substantially rectangular parallelepiped shape which is long in the left-right direction. Four recesses 78*a* are formed in the suction box 78 to match with the shape of the damper device 25. A plurality of suction holes 80 which communicate the inside and outside of the suction box 78 are formed in a suction surface 78*c* of the suction box 78. The suction surface 78*a* is a wave-shaped surface which is formed by a bottom surface and a side surface of each of the recesses 78*a*, and an upper-end surface of a wall portion 78*b* which partitions the adjacent recesses 78*a*.

Further, a restraining tool 83 for restraining the film 24 in a state of making a close contact with the elastic walls 40 and the supporting edge portions 50 is assembled into the suction unit 77. The restraining tool 83 includes a front plate 84 having a shape similar to that of the front wall of the above-described suction box 78, and a rear plate 85 having a shape similar to that of the rear wall of the suction box 78; and upper-end portions at the both sides of the front plate 84 and upper-end portions at the both sides of the rear plate 85 are shaped to be connected by cross-linking plates 86 and 87 each having a rectangular shape. Further, a separating distance between the front plate 84 and the rear plate 85 is set to be slightly greater than a dimension of the suction box 78 in the front and rear direction, and the restraining tool 83 can be fitted externally by attaching onto and covering the suction box 78, from a side of the suction surface 78*c* (upper side in FIG. 12).

An upper-side edge portion 84*a*, which is located at a central portion in the left-right direction of the front plate 84 of the above-described restraining tool 83 has a waveform-shaped outline, and has a shape which substantially matches with the peripheral portions 40*a* of the elastic walls 40. Further, an upper-side edge portion 85*a*, which is located at a central portion in the left-right direction of the rear plate 85 of the restraining tool 83, also has a waveform-shaped outline, and has a shape which substantially matches with the outer shapes of the supporting edge portions 50.

As shown in a 3-2 step (third-second step) in FIG. 12, the restraining tool 83 is fitted externally to the suction box 78 of the above-described suction unit 77, and the film 24 is arranged on a side of the suction surface 78*c*. Further, by using a pressing jig 89 having a structure in which four cylinder-shaped (rod-shaped) members 87 are supported by a block 88 having a rectangular parallelepiped shape, the film 24 is brought in close (tight) contact by pressing the film 24 against the recesses 78*a* of the suction box 78. In the pressing jig 89, each of the cylinder-shaped members 87 is provided to correspond to one of the recesses 78*a* of the suction box 78; and each of the cylinder-shaped members 87 have a diameter same as or slightly smaller than the radius of curvature R2 (see FIG. 8) of one of the recess-shaped connecting portions 43, and the cylinder-shaped members 87 are positioned at a predetermined interval (distance) substantially same as the interval at which the recess-shaped connecting portions 43 are arranged. In this manner, by pressing the film 24 toward the suction surface 78*c* by the cylinder-shaped members 87, the film is brought into a substantially close (tight) contact with the recesses 78*a*. Further, in this state, by discharging air inside the suction box 78, the film 28 is brought completely into a close (tight) contact with the recesses 78*a* by the air sucked through the suction holes 80. Furthermore, as shown in a 3-3 step (third-third step), by removing the pressing jig 89 while maintaining a negative pressure by discharging air inside the suction box 78, it is possible to maintain the film 24 in a waveform shape matched with the suction surface 78*c*.

In the third step shown in the above-described FIG. 10, the film 24 maintained in the waveform shape in such manner is set on the substrate 21 together with the suction unit 77 and the restraining tool 83. Accordingly, the film 24 makes a contact with the supporting edge portions 50, the cross-linking ribs 55, and the peripheral portions 40*a* of the elastic walls 40. Further, as shown in the fourth step in FIG. 11, the suction unit 77 is removed while the restraining tool 83 is left as it is; and as shown in the fifth step, a heater 90 is brought into contact with the film 24 from above the film 24. Here, when the suction unit 77 is removed, the air discharge is stopped and the suction box 78 is made to have atmospheric pressure or a slightly positive pressure such that there is no shift or deviation in the position of the film 24 due to a movement of the suction unit 77. However, since the film 24 is restrained by the restraining tool 83 and is pressed against the substrate 21, the positional shift does not occur even when external force to some extent acts on the film 24.

Figure 11:
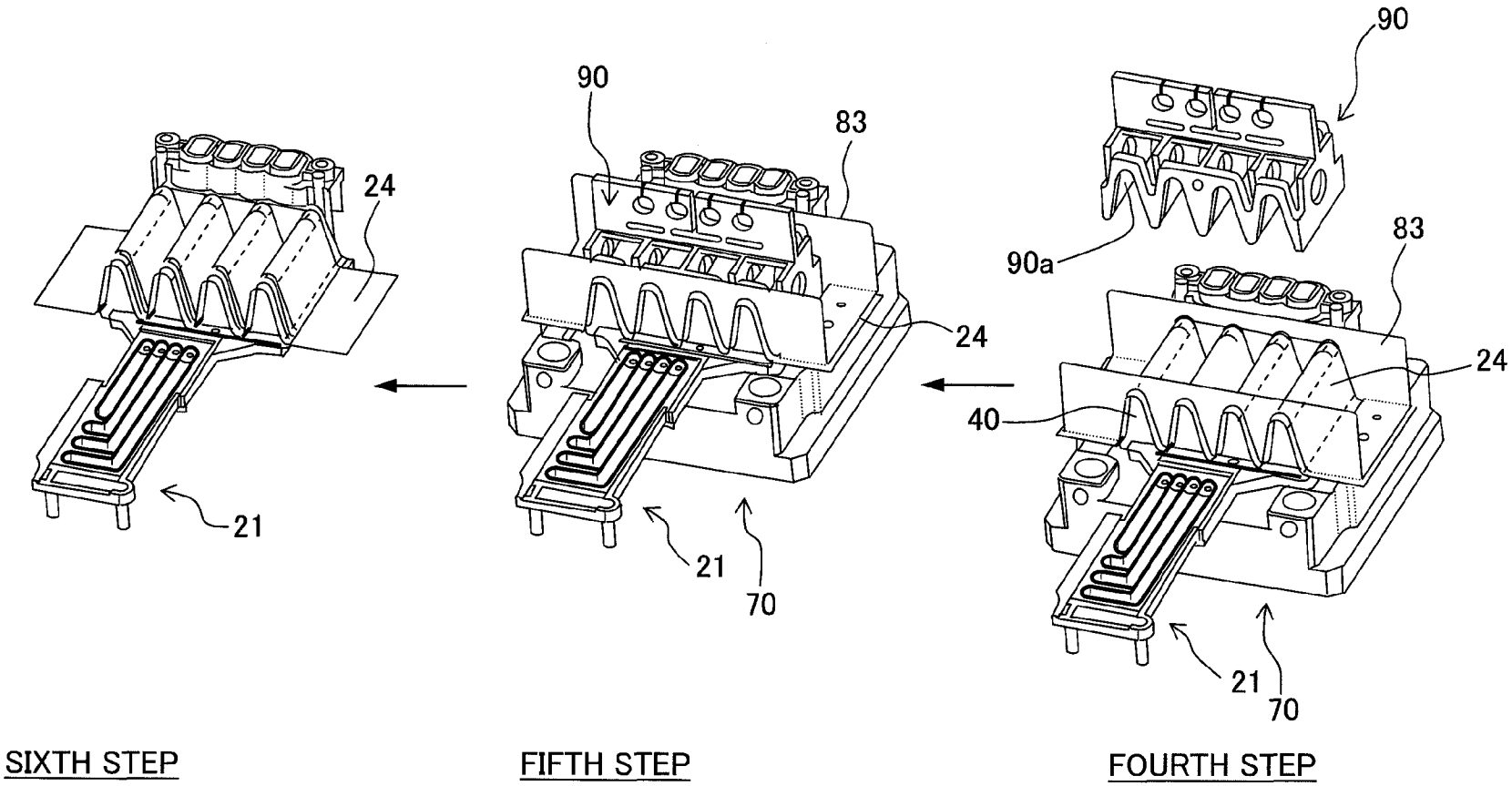
FIG. 11 is a diagram for explaining the method of manufacturing of the damper device while dividing the method into the first to sixth steps, and shows the fourth to sixth steps, up to formation of the damper device by welding (adhering) the film which has been set.

As shown in FIG. 11, the heater 90 has an electric heating portion 90*a* which is matched with the outer shape of the restrained film 24. Further, in the fifth step, by perform the heating by the heater 90, the supporting edge portions 50, the cross-linking ribs 55, and the peripheral portions 40*a* of the elastic walls 40 are fused (melted) through the film 24, which in turn becomes a binder in which one side of the two sides, which are facing each other, of the film 24 having the form of a rectangular sheet is welded to the peripheral portions 40*a* of the elastic walls 40, and the other side of the two sides is welded to the supporting edge portions 50; and further, portions between these two sides is welded to the cross-linking ribs 55 respectively. As already described above, the projections 44 and 56 are provided to the peripheral portion 40*a* of the elastic wall 40 and the cross-linking rib 55 respectively, and actually, these projections 44 and 56 are melted to become the binder and the elastic walls 40 and the cross-linking ribs 55 are welded to the film 24.

When the welding of the film 24 to the substrate 21 is completed when a predetermined time is elapsed, then, as shown in the sixth step, the jig 70, the restraining tool 83, and the heater 90 are removed, thereby completing the operation for welding the film 24 to the substrate 21.

By welding the film 24 to the substrate 21 by such method of manufacturing, it is possible to simultaneously form the plurality of ink storage chambers 35*a* to 35*d* of which volumes change three dimensionally. Further, since the elastic walls 40 and the supporting edge portions 50 are supported from the inner side by the first supporting projections 73 and the second supporting projections 74 of the jig 70, and the two side portions which are face-to-face of the film 24 are supported by the restraining tool 83, it is possible to prevent the positional shift or deviation of the film 24 relative to the elastic walls 40 and the supporting edge portions 50, thereby improving the welding accuracy. Further, as already described above, since the shape along the edge portion of the projection 44 substantially coincides with the shape of the peripheral portion 40*a* of the elastic wall 40 (see FIG. 8A), even when the projection 44 is fused as described above, the shape of the film 24 is maintained before and after the fusion. Therefore, it is possible to prevent the positional deviation of the film 24 and occurrence of creases (wrinkles), etc. in the film 24.

Figure 13A:
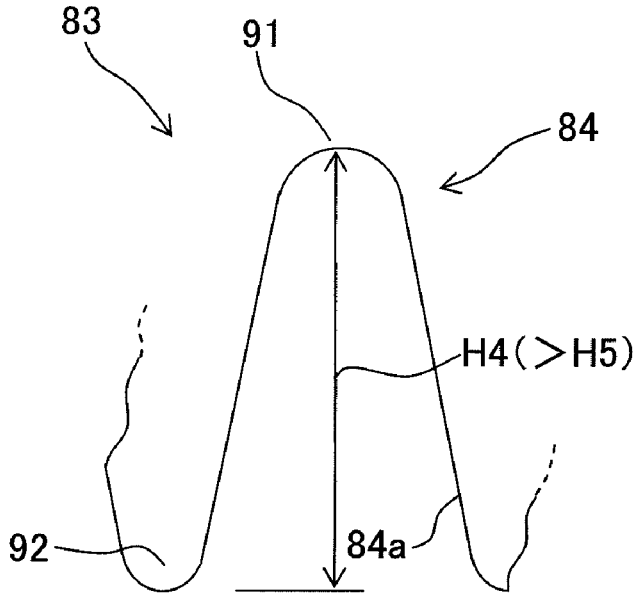
FIG. 13A is an enlarged view of the elastic wall and FIG. 13B is an enlarged view of a locking tool (restraining tool).
Figure 13B:
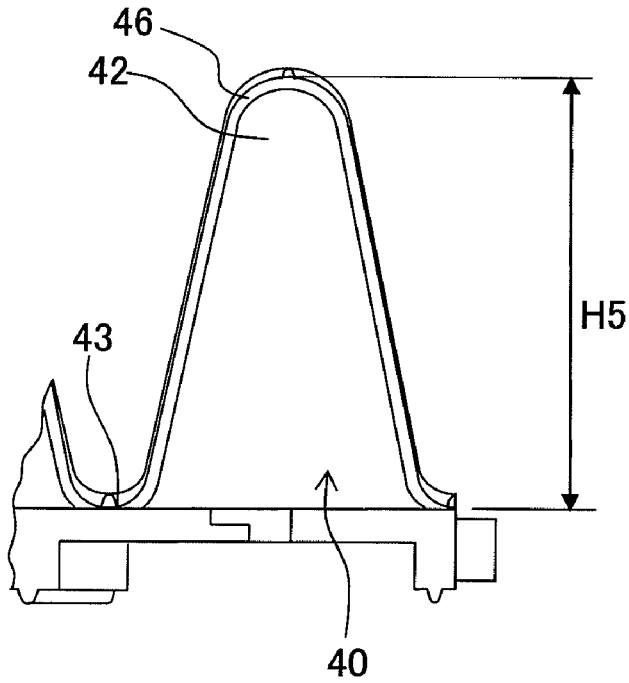

Further, in the method of manufacturing according to the embodiment, even when there is error to some extent in the height dimension of the elastic wall 40 and the supporting edge portion 50, it is possible to bring the film 24 in a close contact with the elastic wall 40 and the supporting edge portion 50 by the restraining tool 83. To explain specifically, as shown in an enlarged view of the elastic wall 40 and the restraining tool 83 in FIG. 13, at the upper-side edge portion 84*a* of the front plate 84 of the restraining tool 83, a height H4 between a recess 91 and a projection 92 corresponding to the recess-shaped connecting portion 43 and the apex portion 42 of the elastic wall 40 is formed to be greater to some extent than a height H5 between the recess-shaped connecting portion 43 and the apex portion 42 of the elastic wall 40 (more precisely, from the lowest point of the recess-shaped connecting portion 43 to the highest point of the flange portion 46, in a state shown in FIG. 13). Consequently, when the restraining tool 83 is set to the substrate 21, and the upper-side edge portion 84*a* is engaged with the elastic wall 40, a slight gap is provided between the apex portion 42 of the elastic wall 40 and the corresponding recess 91 of the restraining tool 83. Therefore, even when there is error to some extent in the height dimension of the elastic wall 40, it is possible to accommodate (absorb) such error and to bring the film 24 in a close contact via the projection 44, over the entire area of the peripheral portion 40*a* of the elastic wall 40. A relationship similar to that described above holds also between the upper-side edge portion 85*a* of the rear plate 85 of the restraining tool 83 and the supporting edge portion 50, and it is possible to bring the film 24 in a close contact with the entire area of the supporting edge portion 50.

In the embodiment, a film in the form of a rectangular sheet when the film is spread out (rolled out) is used as the films 22 to 24, and it is possible to obtain a large number of films 22 to 24 highly efficiently from a large film material. However, it is not necessarily indispensable that the films 22 to 24 are required to have a rectangular shape in the spread-out state. In particular, reference is made about the film 24 which forms the ink storage chambers 35*a* to 35*d*, as it is appreciated from the above-described explanation, a rectangular-shaped area of the film 24, surrounded at welding locations at which the film 24 is welded to the cross-linking ribs 55, the supporting edge portions 50 and the peripheral portions 40*a* of the elastic walls 40 exhibits the damper function of reducing the pressure fluctuation in the ink. Consequently, when the rectangular-shaped area is secured, the damper device 25 has the desired function; and thus from this point of view of this function, the shape of the film at the outer side of the rectangular-shaped area may be any shape.

In the above-described description, the explanation has been made by an example of the printing apparatus which jets an ink as the liquid jetting apparatus. However, the present invention is not limited to this, and is widely applicable to a damper device which is used in a liquid jetting apparatus which jets a liquid other than ink. As the films 22, 23 and 24 described above, a film made of a same material and a same thickness may be used, or films made of different materials and different thicknesses may be used. In other words, the materials and thickness of the films 22, 23 and 24 can be arbitrary as long as the films 22, 23 and 24 have enough flexibility to function as a dumper. Preferably, a flexible film for the films 22, 23 and 24 can be formed as stacked thin films which are made of thin films of, for example, polypropylene, polyethylene, nylon and polyethylene terephthalate. Preferably, a total thickness of the flexible film can range from about 10 μm to about 100 μm, more preferably the total thickness can be about 50 μm. The flexible film can be formed as multi-layers or a single-layer.

The present invention is applicable to a damper device which is capable of stably exhibiting high damper performance, and in which the layout of channels which are connected to the damper device is simple. Further, the present invention is applicable to a damper device which has a small size and which is easy to manufacture. Furthermore, the present invention is applicable to a damper unit which is used in such damper device, and a method of manufacturing the damper device.

What is claimed is:

1. A damper device which is provided on an intermediate potion of a channel supplying a liquid to a jetting head and which reduces a fluctuation in a pressure of the liquid, the damper device comprising:

a storage chamber storing the liquid, and formed of: a substrate; a pair of supporting portions which are arranged to face each other in a predetermined facing direction, which project from the substrate, and peripheral portions of which have shapes substantially same with each other; and a film which is flexible and which has a sheet shape;

wherein the film is connected to the peripheral portions of the pair of supporting portions, and the storage chamber is formed as a space having a curved surface defined by the film.

2. The damper device according to claim 1, wherein the pair of supporting portions are formed as a plurality of pairs of supporting portions, and are aligned such that facing directions in each of which the supporting portions of one of the pairs of supporting portions face each other are aligned in parallel; and one piece of the film is connected to the peripheral portions of each of the pairs of the supporting portions, and the storage chamber is formed as a plurality of storage chambers aligned in parallel.

3. The damper device according to claim 1, wherein a shape of the storage chamber is a pillar shape extended in the facing direction of the pair of supporting portions; and a cross-sectional shape, of the storage chamber, orthogonal to the facing direction is substantially same at any of locations in the facing direction.

4. The damper device according to claim 1, wherein the film has a rectangular shape when the film is spread out and having two facing sides which face each other; and one side of the two facing sides is connected to the peripheral portion of one of the supporting portions, and the other side of the two facing sides is connected to the peripheral portion of the other of the supporting portions.

5. A damper unit which constructs a damper device provided on an intermediate portion of a channel supplying a liquid to a jetting head, the damper device including a storage chamber which stores the liquid and reducing a fluctuation in a pressure of the liquid, the damper unit comprising:

a substrate in which a part of the channel is formed; and a pair of supporting portions which are arranged to face each other, which project from the substrate, and of which peripheral portions have shapes substantially same with each other;

wherein the storage chamber is defined when a film which is flexible and which has a sheet shape is connected to the peripheral portions of the supporting portions.

6. The damper unit according to claim 5, wherein a shape of each of the supporting portions is symmetrical with respect to a line connecting a base-end portion of the supporting portion connected to the substrate and a front-end portion of the supporting portion which is farthest from the substrate.

7. The damper unit according to claim 5, wherein at least one supporting portion forming the pair of supporting portions has a protruding wall portion which is protruded with respect to the substrate, and a flange portion having a large width and formed to extend along a periphery of the protruding wall portion.

8. The damper unit according to claim 7, wherein an inner surface of the flange portion is a contact surface with which a jig performing positioning with respect to a heater is brought into contact when the film is thermally welded to an outer surface of the flange portion.

9. The damper unit according to claim 5, wherein each of the supporting portions is formed such that a dimension from a base-end portion, of each of the supporting portions, connected to the substrate up to a front-end portion of each of the supporting portions which is farthest from the substrate are formed to be all same.

10. The damper unit according to claim 5, wherein a projection is provided on each of the supporting portions at the peripheral portion thereof, the projection extending along the peripheral portion;

the projection is formed such that a height of the projection at a portion of the projection in the vicinity of a base end portion, of each of the supporting portion, connected to the substrate is smaller than a height of the projection at a portion of the projection in the vicinity of a front-end portion, of each of the supporting portion, which is farthest from the substrate; and a contour of the projection and a contour of the peripheral portion are substantially same.

11. A method of manufacturing a damper device which is provided at an intermediate portion of a channel supplying a liquid to a jetting head and which reduces a fluctuation in a pressure of the liquid, the method comprising:

forming a damper unit having: a substrate in which a part of the channel is formed; and a pair of supporting portions which are arranged to face each other, which project from the substrate, and of which peripheral portions have shapes substantially same with each other; and forming a storage chamber by connecting a film, which is flexible and which has a sheet shape, to the peripheral portions of the supporting portions.

12. The method of manufacturing the damper device according to claim 11, wherein a restraining tool having a pressing surface which substantially matches with the shapes of the peripheral portions of the supporting portions is used to press the film against the peripheral portions; and the film is connected to the peripheral portions while the film is pressed against the peripheral portions with the pressing surface.

13. The method of manufacturing the damper device according to claim 12, wherein when a portion, of the restraining tool, corresponding to a front-end portion of each of the supporting portions is formed such that when the portion is fitted into the supporting portion, a slight gap is provided between the front-end portion and the portion of the restraining tool.

14. The method of manufacturing damper device according to claim 11, comprising:

forming at least one supporting portion forming the pair of supporting portions to have a protruding wall portion which protrudes with respect to the substrate, and to have a flange portion having a large width and extending along a periphery of the protruding wall portion; and connecting the film to an outer surface of the flange portion while bringing a positioning jig in contact with an inner surface of the flange portion.

15. The damper device according to claim 1, wherein the supporting portions include an elastic wall formed to project from the substrate; and the elastic wall and the flexible film are formed to be deformable accompanying with a fluctuation of a pressure in the storage chamber, and to be capable of changing a volume of the storage chamber.

16. The damper device according to claim 15, further comprising a supporting edge portion which is arranged to face the elastic wall, and which has a substantially same shape as a peripheral portion of the elastic wall;

wherein the flexible member is formed of a film having a sheet shape; and when the film is connected to the supporting edge portion and the peripheral portion of the elastic wall, the storage chamber is formed as a space of which peripheral surface defined by the film is a curved surface.

17. The damper device according to claim 16, wherein the film is rectangular shaped when the film is spread out.

18. The damper device according to claim 16, wherein a shape of the storage chamber is a pillar shape extended in a facing direction in which the elastic wall and the supporting edge portion are faced to each other.

19. The damper device according to claim 18, wherein each of the elastic wall and the supporting edge portion are formed to be have a triangular shape or trapezoidal shape having an apex portion; and the shape of the storage chamber is a substantially triangular pillar shape or substantially trapezoidal shape having a ridge portion which is formed between the apex portion of the elastic wall and the apex portion of the supporting edge portion.

20. The damper device according to claim 16, wherein the elastic wall has a thin portion of which thickness is smaller than that of the substrate.

21. The damper device according to claim 16, wherein a shape of the elastic wall is a crank shape in which a front-end portion, of the elastic wall, including the apex portion is offset in a normal direction of the elastic wall with respect to a base-end portion, of the elastic wall, which is connected to the substrate.

22. The damper device according to claim 16, wherein the elastic wall and the supporting edge portion are formed as a plurality pairs of elastic walls and supporting edge portions, and the elastic walls and the supporting edge portions are arranged such that facing directions in which the elastic walls and the supporting edge portions face each other respectively are aligned in parallel; and one piece of the film is connected to the pairs of elastic walls and the supporting edge portions, and the storage chamber is formed as a plurality of storage chambers aligned in parallel.

23. The damper device according to claim 22, comprising ribs each of which connects a connecting location at which adjacent elastic walls among the elastic walls are connected and a connecting location at which adjacent supporting edge portions among the supporting edge portions are connected;

wherein a portion, of the film, which is located between another portions of the film connected to the elastic walls and the supporting edge portions, is connected to an end surface of each of the ribs, and a trough portion which partitions adjacent storage chambers among the plurality of storage chambers is formed; and the ridge portion of each of the storage chambers has a cross sectional shape of which radius of curvature is greater than that of the trough portion formed between the adjacent storage chambers.

24. The damper device according to claim 22, wherein each of the storage chambers is arranged with the ridge portion as a bottom portion of the storage chamber;

and an upper space portion above the liquid stored inside the storage chamber forms a first air storage portion.

25. The damper device according to claim 24, further comprising a plurality of liquid tanks each of which is provided, corresponding to one of the plurality of storage chambers, on an intermediate portion of a channel extending from one of the storage chambers up to the jetting head;

wherein the liquid tanks are aligned, along an alignment direction of the storage chambers, at one side of an alignment direction of the elastic walls and the supporting edge portions with respect to the storage chamber;

an upper space portion, of each of the liquid tanks, above the liquid stored inside the liquid tank forms a second air storage portion; and the first air storage portion of each of the storage chambers and the second air storage portion of each of the liquid tanks corresponding to one of the storage chambers are communicated with each other.

26. The damper device according to claim 25, wherein the first air storage portion and the second air storage portion are partitioned from an outside by a ceiling surface which is a flat surface.

27. The damper device according to claim 26, wherein the ceiling surface is formed by a film.

28. The damper device according to claim 26, wherein the ceiling surface of the first and second air storage portions is formed by one film.

29. The damper device according to claim 16, wherein the storage chamber is formed as a plurality of storage chambers having elastic walls and supporting edge portions, respectively; the storage chambers are arranged such that facing directions of the elastic walls and the supporting edge portions are substantially orthogonal to a scanning direction of the jetting head; and inlets for the liquid into the storage chambers are arranged on one end in the facing directions and outlets for the liquid are provided at the other end in the facing directions.

30. A liquid jetting apparatus comprising:

a liquid tank unit which stores a liquid;

a jetting head in which a nozzle hole for jetting the liquid supplied from the liquid tank unit is formed; and the damper device as defined in claim 1 which is arranged between the liquid tank unit and the jetting head.

* * * * *